US005913273A

United States Patent [19]

Maejima

[11] Patent Number: 5,913,273

[45] Date of Patent: Jun. 22, 1999

[54] INCINERATOR INCLUDING VIBRATOR AND INCINERATOR INCLUDING DRYING CHAMBER

[75] Inventor: Takashi Maejima, Kawasaki, Japan

[73] Assignee: Maejima Kogyosho Co., Ltd., Kawasaki, Japan

[21] Appl. No.: 08/624,630

[22] PCT Filed: Sep. 20, 1995

[86] PCT No.: PCT/JP95/01888

§ 371 Date: Apr. 24, 1997

§ 102(e) Date: Apr. 24, 1997

[87] PCT Pub. No.: WO96/10150

PCT Pub. Date: Apr. 4, 1996

[30] Foreign Application Priority Data

Sep. 26, 1994 [JP] Japan ..... 6-256300
May 6, 1995 [JP] Japan ..... 7-132663

[51] Int. Cl.[6] ..... F23G 5/00; F23K 3/02; F23J 11/00; F23M 7/00

[52] U.S. Cl. ..... 110/248; 110/104 R; 110/147; 110/162; 110/166; 110/173 R; 110/185; 110/210; 110/211; 110/216; 110/224; 110/225; 110/253; 110/256; 110/258; 110/259; 126/60; 126/64; 126/65; 126/155; 126/242; 126/245

[58] Field of Search ..... 110/104 R, 119, 110/147, 162, 165 R, 166, 185, 210, 211, 214, 216, 224, 225, 233, 235, 246, 248, 249, 251, 252, 255, 256, 258, 259, 253, 173 R; 126/60, 64, 65, 155, 168, 242, 245, 243

[56] References Cited

U.S. PATENT DOCUMENTS 2,959,140 11/1960 Friedberg ..... 110/253
5,311,828 5/1994 Wu et al. ..... 110/248
5,564,348 10/1996 Groschl et al. ..... 110/248 X

*Primary Examiner*—Ira S. Lazarus
*Assistant Examiner*—Ljiljana V. Ciric
*Attorney, Agent, or Firm*—Armstrong, Westerman, Hattori, McLeland & Naughton

[57] ABSTRACT

A waste incinerator including separate burning-, blower-, chimney- and ash-receiving chambers. A suction-discharge port is provided in a wall between the burning chamber and the chimney chamber for discharging gases from the burning chamber through a chimney to the atmosphere. The chimney extends from the chimney chamber for discharging gases to the atmosphere. The chimney receives an air feed pipe from the blower and an ignition sleeve extends into the chimney for burning unconsumed waste gas. A vibrator vibrates an ash receiver in the ash receiving chamber, and a drying chamber may be provided for drying high moisture garbage by combustion gases from the burning chamber.

9 Claims, 14 Drawing Sheets

INCINERATOR INCLUDING VIBRATOR AND INCINERATOR INCLUDING DRYING CHAMBER

TECHNICAL FIELD

The present invention relates to improvement of a burning furnace for burning ordinary refuse containing little moisture, as well as garbage, sludge, or the like, having a high quantity of moisture wherein the refuse, garbage, sludge, or the like, are discharged from a factory, a restaurant, a convenience store, or the like.

BACKGROUND ART

Conventionally, with a small sized burning furnace for burning refuse discharged from a restaurant, a superstore, a convenience store, or the like, ash deposited in the burning furnace after completion of a burning operation is manually taken from the burning furnace, and the refuse, which cannot be burned, is burned again in the furnace after the ash is taken out therefrom.

On the other hand, ordinary refuse containing no moisture, as well as garbage containing a high quantity of moisture, discharged from a factory, a restaurant, a supermarket, a convenience store, or the like, are forcibly burned in the furnace by operating a burner, or the like.

However, ordinary refuse containing little moisture can easily be burned in the burning furnace but garbage containing a large quantity of moisture cannot be completely burned under the same conditions as those for the ordinary refuse.

Ash remaining in the burning furnace as waste after completion of a burning operation for refuse and garbage is deposited in the burning furnace, resulting in the material to be burned failing to be completely burned. Thus, after unburned waste is removed from the burning furnace, it is ignited and burned. For this reason, a drawback of the conventional burning furnace is that many manhours are required until the waste and the garbage are completely burned.

The present invention has been made in consideration of the aforementioned background. An object of the present invention is to provide a burning furnace which is very convenient because, even though a material to be burned continues to burn, ash automatically drops in a receiving tray. Another object of the present invention is to provide a burning furnace including a vibrator as well as a burning furnace including a drying chamber which assure that, after moisture contained in garbage is dried by a burning heat derived from ordinary refuse in a garbage receiving groove, the unburned waste is caused to drop to a burning chamber by actuating a raking rod so as to allow the unburned waste to be completely burned, and moreover, ash is automatically discharged into a receiving tray by the action of vibration of a lattice-shaped vibrating plate without any degrading of burning efficiency due to ash deposited by continuously burning the waste for a long time.

DISCLOSURE OF THE INVENTION

According to the present invention, there is provided an incinerator including a vibrator, wherein the incinerator is characterized in that an ash receiving chamber including an ash receiver is arranged below a burning chamber including a holding plate connected to a vibrator and having a discharging/sucking port in a rear wall surface, a burner chamber including a burner, a blower chamber including a blower having an air feeding pipe and a branch pipe, and a chimney chamber including a chimney are arranged in the burning furnace, the air feeding pipe of the blower is inserted into the chimney, and the foremost end of the branch pipe is disposed in the vicinity of the burner.

In addition, according to the present invention, there is provided an incinerator furnace including an ashing chamber, a burning chamber and a drying chamber, wherein the furnace is characterized in that a plurality of through holes are formed through the burning chamber and the drying chamber, and a partition having a garbage receiving groove formed therein is arranged in the burning furnace. Moreover, according to the present invention, there is provided an incinerator including a burning chamber and a cyclone, wherein a burning chamber and a drying chamber are arranged in the incinerator, a plurality of through holes are formed through the burning chamber and the drying chamber, and a receiving groove for receiving garbage therein is arranged in the incinerator.

DESCRIPTION OF PREFERRED EMBODIMENTS OF THE INVENTION

The present invention will be described in more detail with reference to the accompanying drawings which illustrate preferred embodiments thereof.

Figure 1:
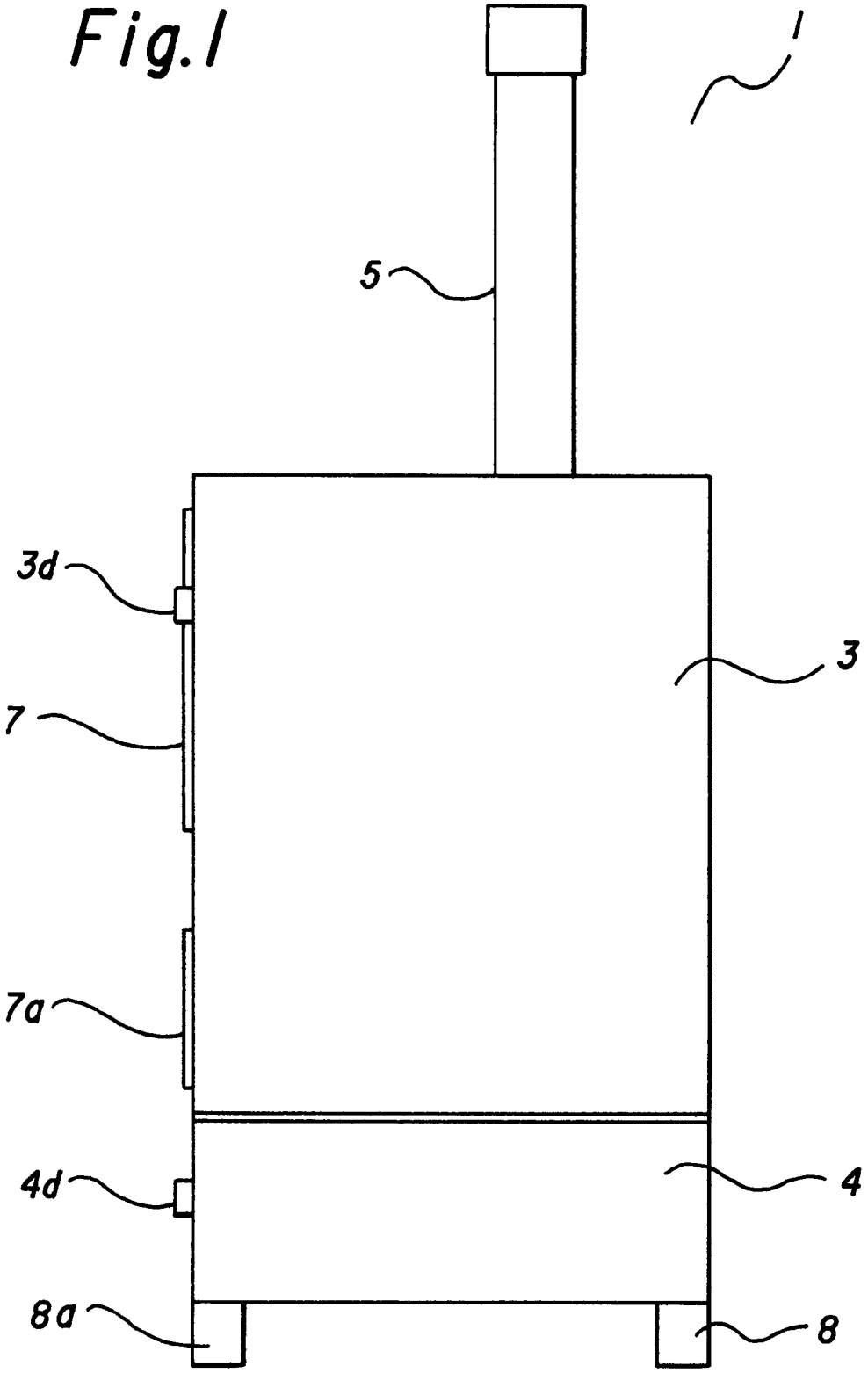
FIG. 1 is a front view of an incinerator including a vibrator in accordance with the present invention.
Figure 2:
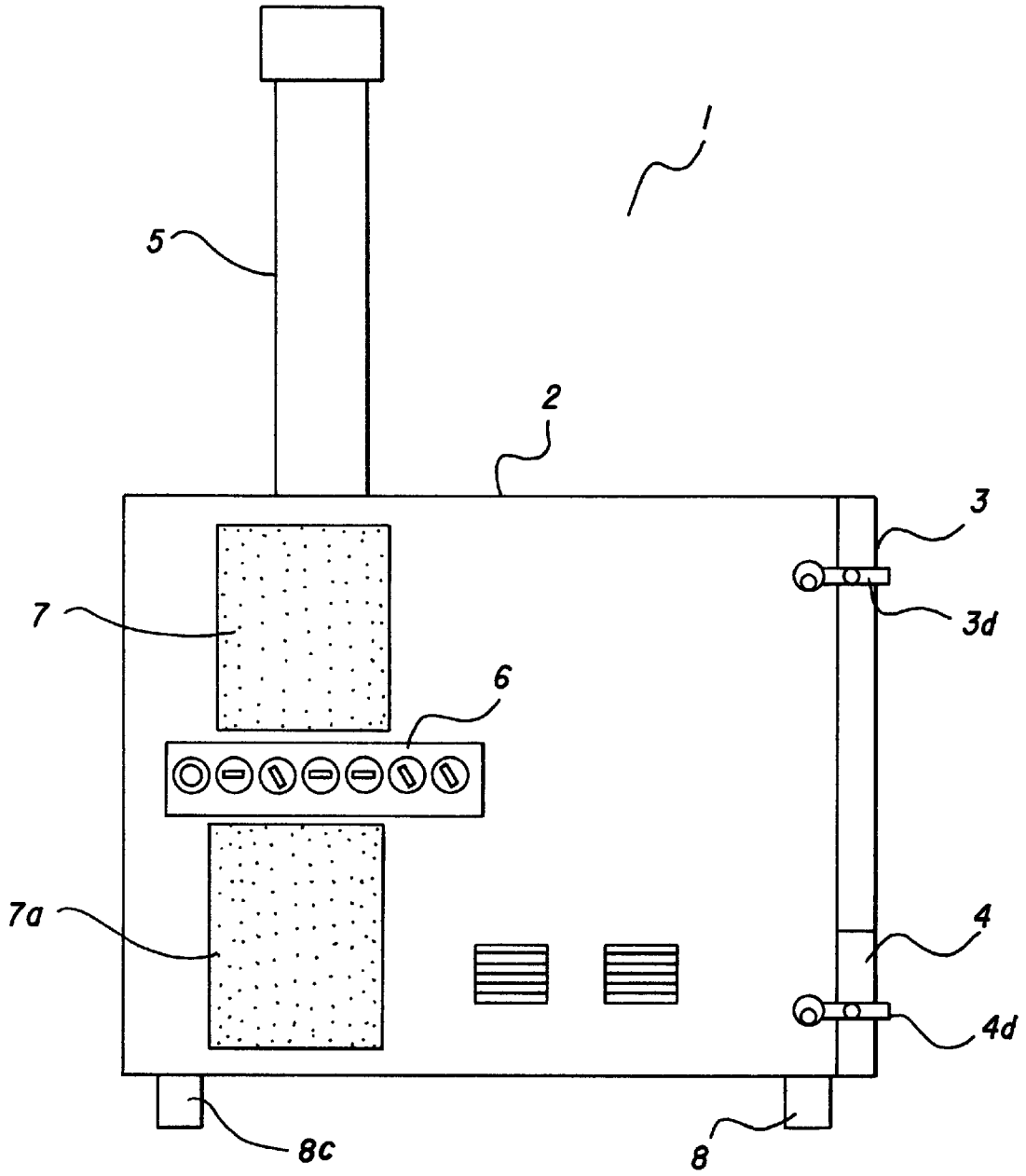
FIG. 2 is a left-hand side view of the incinerator including a vibrator in accordance with the present invention.
Figure 3:
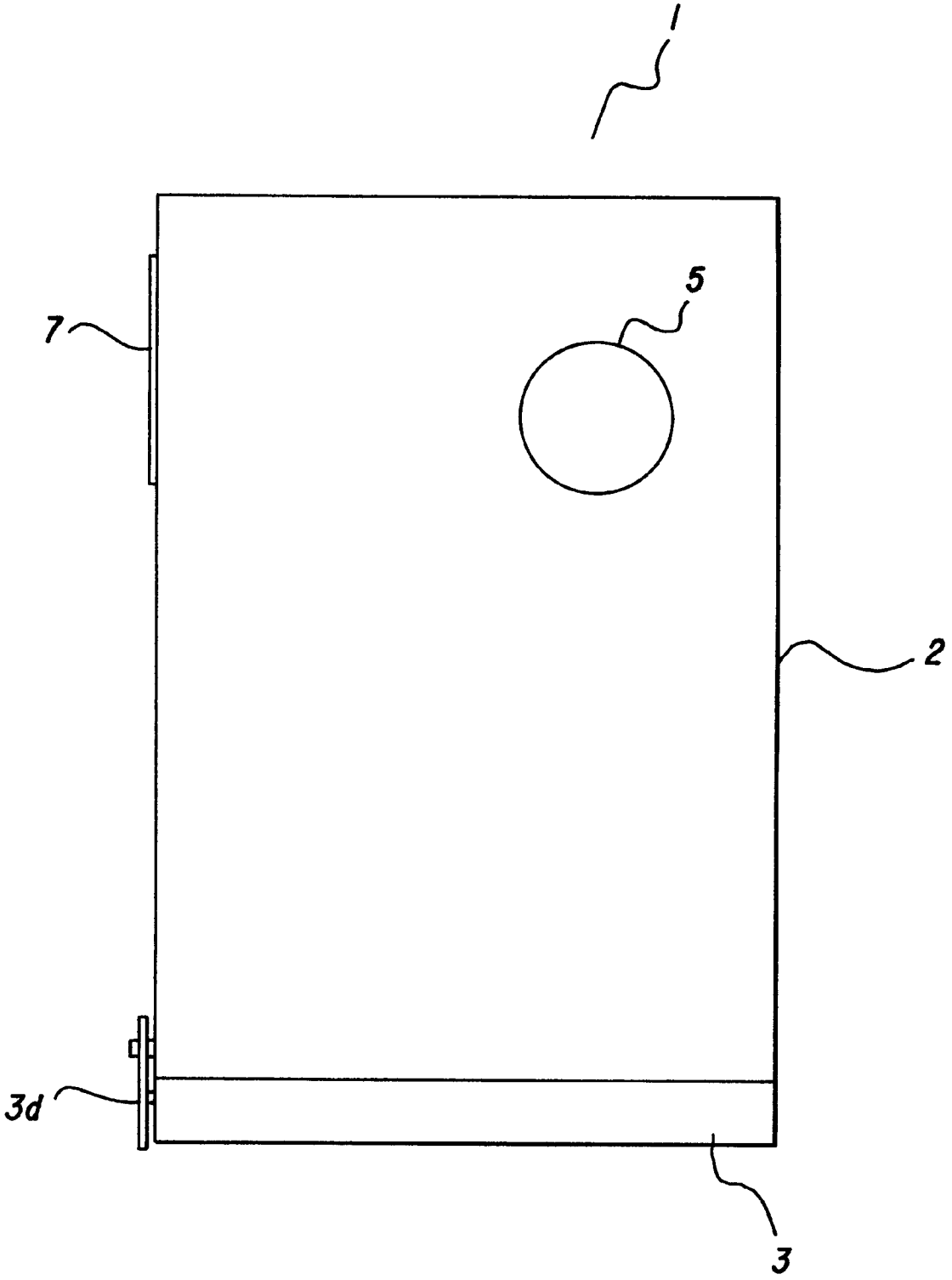
FIG. 3 is a plan view of the incinerator including a vibrator in accordance with the present invention.

FIG. 1 is a front view of an incinerator including a vibrator in accordance with the present invention; FIG. 2 is a left-hand side view of the incinerator including a vibrator in accordance with the present invention; and FIG. 3 is a plan view of the incinerator including a vibrator in accordance with the present invention.

In the drawings, reference numeral 2 denotes a burning portion. The burning portion 2 exhibits a substantially parallelepiped contour, and includes an upper opening/closing door 3 having an opening/closing lever 3*d*, a lower opening/closing door 4 having an opening/closing lever 4*d*, a chimney 5 on the rear upper surface, and a switch board 6 on the left-hand side surface for controlling operation of the incinerator 1.

Reference numeral 7 denotes an upper cover for a burner chamber, reference numeral 7*a* designates a lower cover for the blower chamber, and reference numerals 8, 8*a* and 8*c* denote feet for the burning furnace 1.

Figure 4:
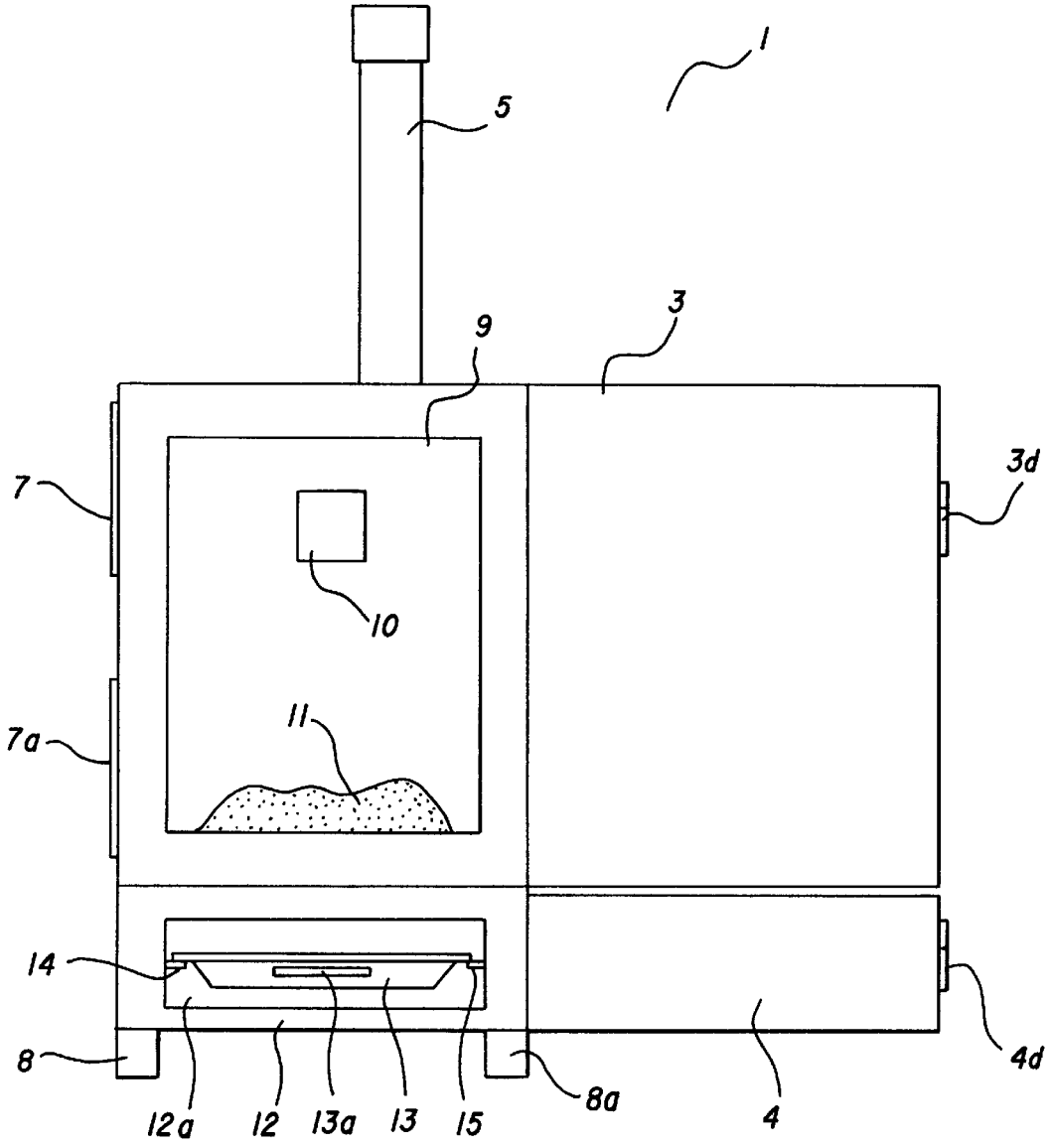
FIG. 4 is a front view of the incinerator including a vibrator in accordance with the present invention wherein a door for the incinerator is fully opened.

FIG. 4 is a front view of the burning furnace including a vibrator in accordance with the present invention while the door is kept fully opened, and the interior of the burning portion 2 is divided into a burning chamber 9, an ash receiving chamber 12*a*, a burner chamber 16, a blower chamber 21 and a chimney chamber 23.

A sucking/discharging port 10 is formed in the rear wall of the burning chamber for allowing the smoke generated when burning a material 11 to be burned to be discharged via the chimney 5, and the sucking/discharging port 10 is communicated with a chimney chamber 23.

An ash receiving chamber 12*a* includes an ash receiver 13 having a handle 13*a* attached thereto, the ash receiver 13 is slidably displaced along left-hand and right-hand guides 14 and 15. When the ash receiver 13 is fully filled with ash, it is pulled forwardly by seizing the handle 13*a* by an operator's hand so that ash in the ash receiver 13 is taken out of the ash receiving chamber 12*a*.

Figure 5:
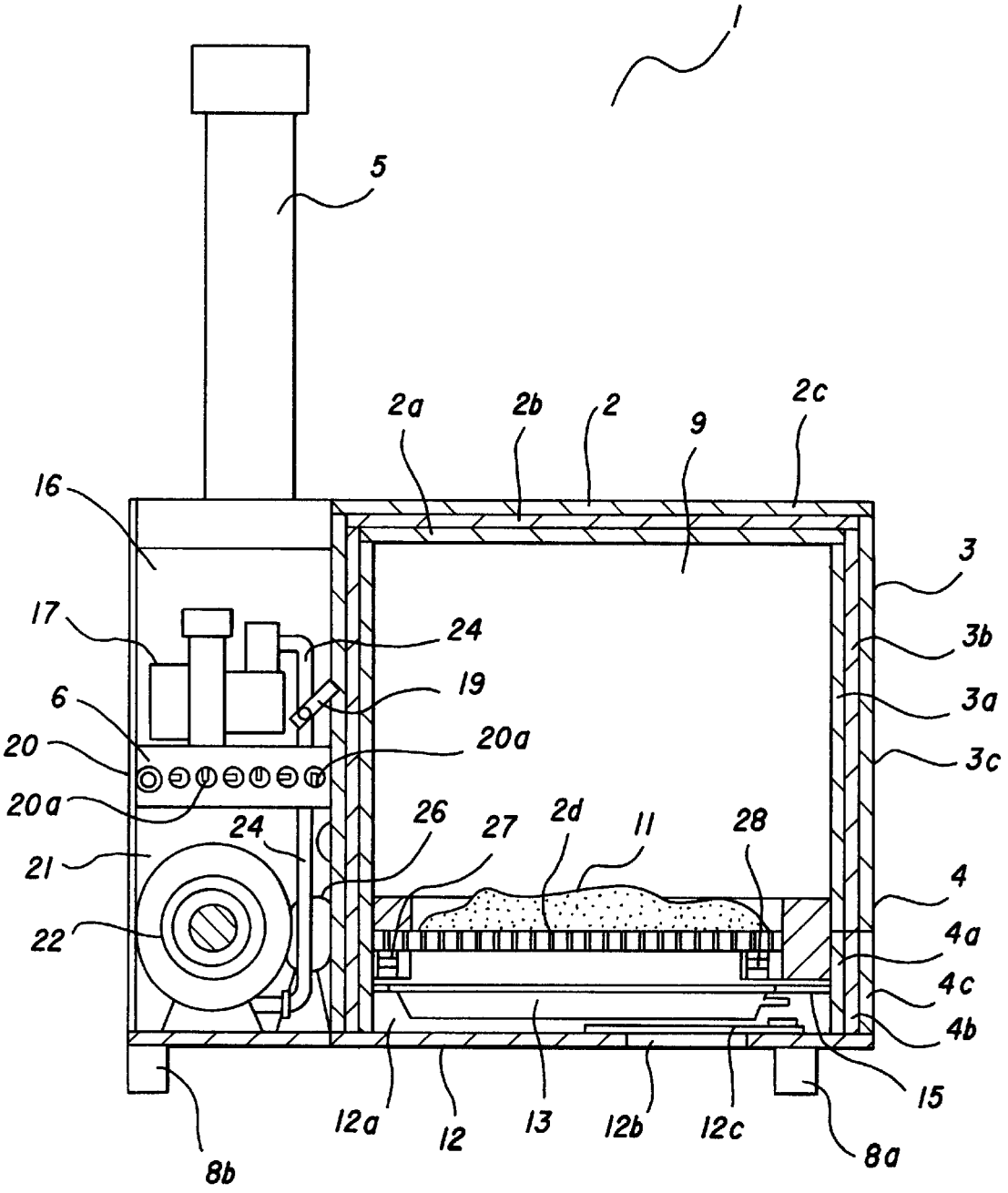
FIG. 5 is a vertical sectional view of the incinerator including a vibrator in accordance with the present invention.
Figure 6:
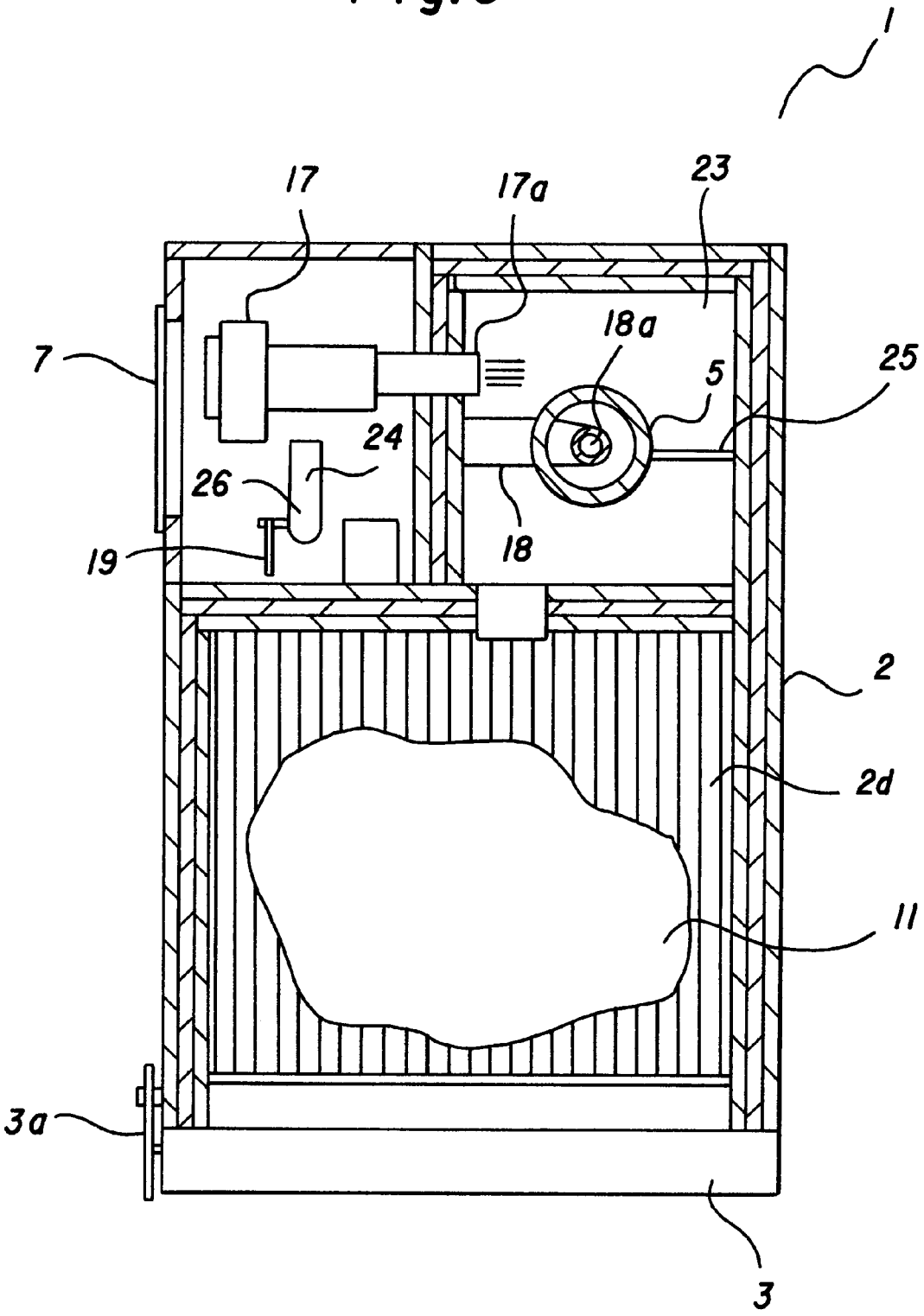
FIG. 6 is a cross-sectional view of the incinerator including a vibrator in accordance with the present invention.
Figure 7:
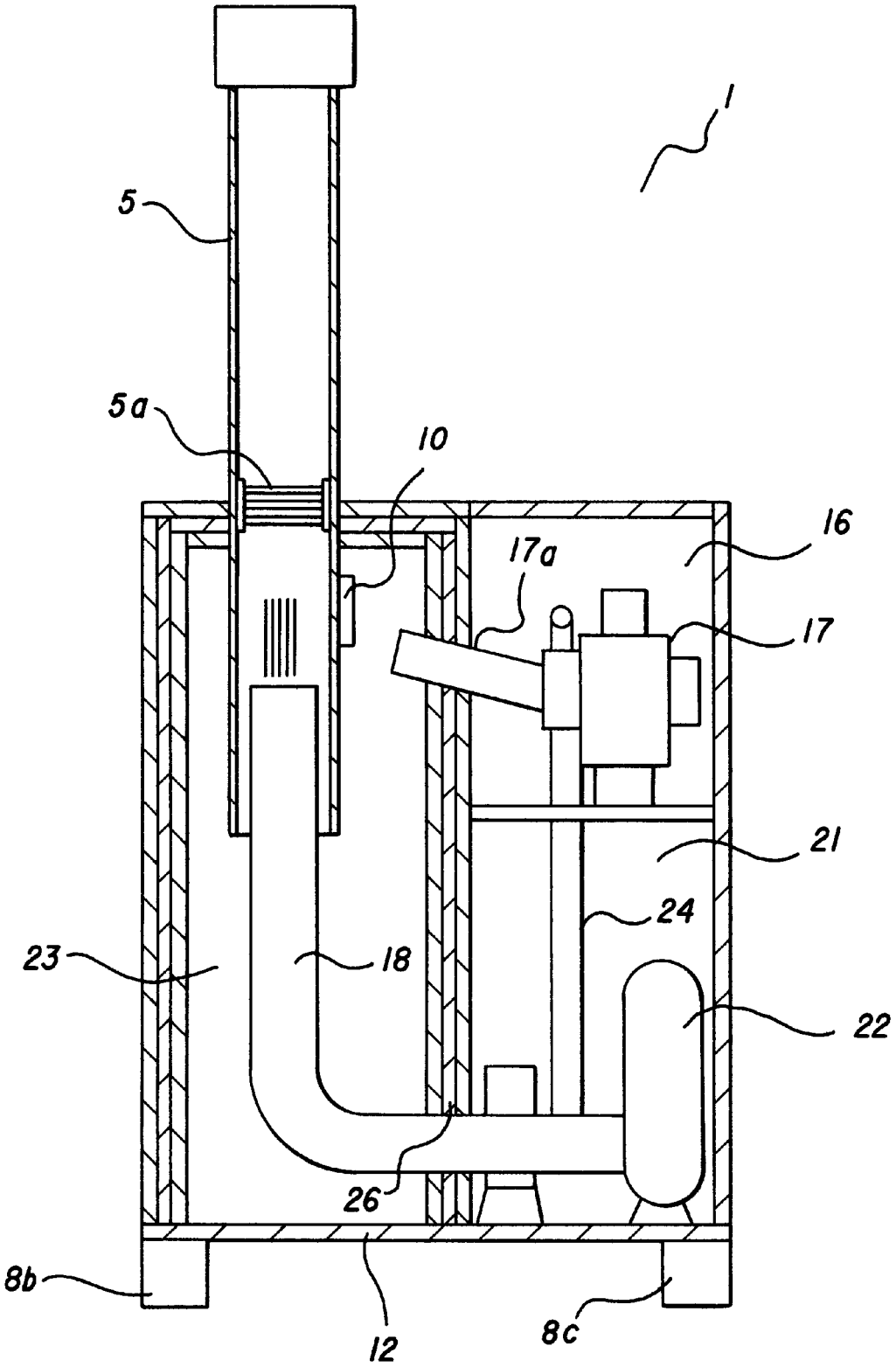
FIG. 7 is a vertical sectional view of the rear part of the incinerator including a vibrator in accordance with the present invention.

FIG. 5 is a vertical sectional view of the incinerator furnace including a vibrator in accordance with the present invention; FIG. 6 is a cross-sectional view of the incinerator including a vibrator in accordance with the present invention; and FIG. 7 is a rear vertical sectional view of the incinerator including a vibrator in accordance with the present invention.

As shown in FIG. 5, since a number of vertical holes are formed through a holding plate 2*d* on which a material 11 to be burned is held, ash derived from burning of the material 11 to be burned drops on the ash receiver 13 through the holes. A vibrator 26 is connected to the holding plate 2*d*, and as the vibrator 26 is driven, the holding plate 2*d* is vibrated. The vibrator 26 is installed in a blower chamber 21. Corners of the holding plate 2*d* are mounted for vibration, and coil springs 27 and 28 are fitted to the respective corners so as to enable the holding plate 2*d* to be effectively vibrated.

An air ventilating hole 12*b* is formed through a bottom plate 12, and air flows through the ventilating hole 12*b*, a number of through holes formed through the holding plate 2*d* and the material 11 to be burned so that the latter is burned at a high efficiency. To adjust a quantity of air to flow through the ventilating hole 12*b*, a manual turn plate 12*c* is turnably placed on the bottom plate 12 to adjustably open or close the ventilating hole 12*b*.

A burner chamber 16 and a blower chamber 21 are arranged behind a burning chamber 9 such that a burner 17 is disposed in the burner chamber 16 and a blower 22 is disposed in the blower chamber 21. The blower 22 includes an air feeding pipe 18, and a branch pipe 24 is branched from the air feeding pipe 18 so that the forward end part of the air feeding pipe 18 is inserted into the chimney 5 and the forward end part of the branch pipe 24 is directed to the burner chamber 16 to cool the burner 17.

A change lever 19 is disposed on the branch pipe 18, and as required, air is fed to the burner 17 by actuating a lever 19 so as to cool the burner 17.

As shown in FIG. 6, the air feeding pipe 18 attached to the blower 22 is inserted into the chimney 5, as mentioned above. The forward end of an ignition sleeve 17*a* of the burner 17 is projected into the interior of a chimney chamber 23 with slight upward inclination. The slight upward inclination of the ignition sleeve 17*a* is intended to completely burn the material to be burned by generating an eddy current at the upper part of the chimney chamber 23. It, of course, is obvious that the ignition sleeve 17*a* may be disposed with a horizontal attitude.

In addition, as air continues to be fed into the chimney 5 via the air feeding pipe 18, an intensity of air pressure in the chimney chamber 23 is reduced, causing hot gas in the burning chamber 9 to be sucked in the chimney chamber 23 from the sucking/discharging port 10 formed on the rear wall of the burning chamber 9. Thus, fresh air flows in the combustion chamber 9 so that the material 11 to be burned is efficiently burned.

Reference numeral 5*a* denotes a heater. By disposing the heater 5*a* in the chimney 5, fine refuse which enters the chimney 5 without burning in the burning chamber 8 and then is discharged to the atmosphere from the chimney 5 can completely be burned by the heater 5*a*. It, of course, is obvious that the heater 5*a* may not be required.

To assure that the burning furnace is centrally controlled at a single location, a switch board 6 is arranged between the burner chamber 16 and the blower chamber 21. A variety of actuating buttons, such as an ON/OFF button, a timer, or the like, are disposed on the switch board 6 in order to drive the vibrator 26, the blower 22, the burner 17, or the like, and moreover, actuate the vibrator 26 at a predetermined time.

Since the upper and lower opening/closing doors 3 and 4, the burning chamber 9 and the chimney chamber 23 are exposed to an elevated temperature, the wall of each of the chambers has a three-layered structure. Specifically, each wall is composed of inner materials 2*a* and 3*a*, intermediate materials 2*b* and 3*b* and outer materials 2*c* and 3*c*, and cast refractory is used for the inner materials, ceramic wool is used for the intermediate materials and glass wool is used for the outer materials.

Figure 9:
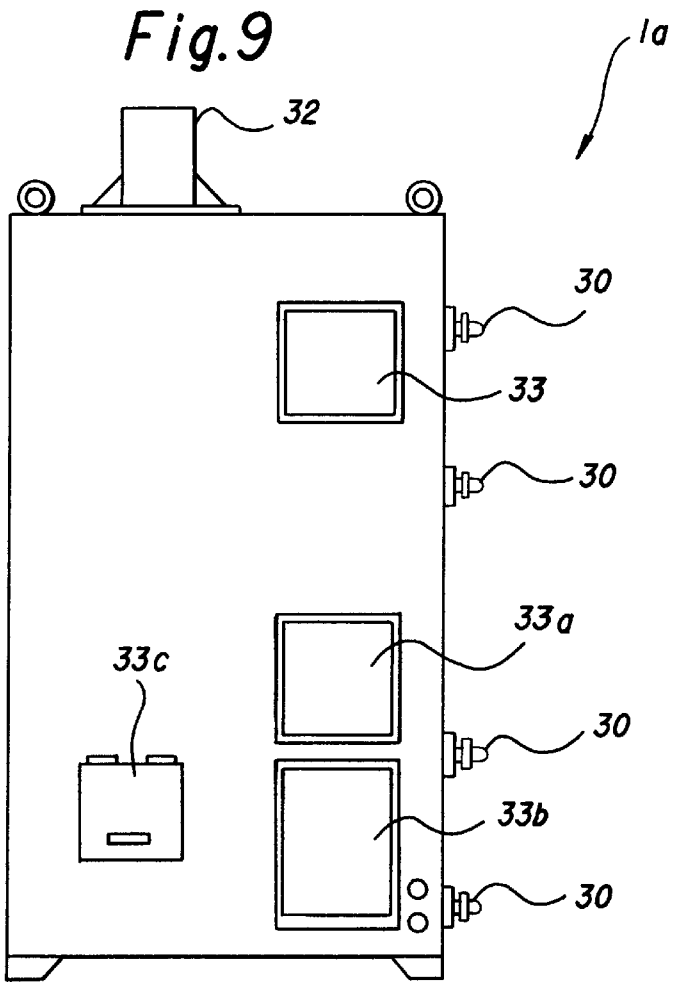
FIG. 9 is a rear view of the incinerator including a drying chamber in accordance with the present invention.
Figure 8:
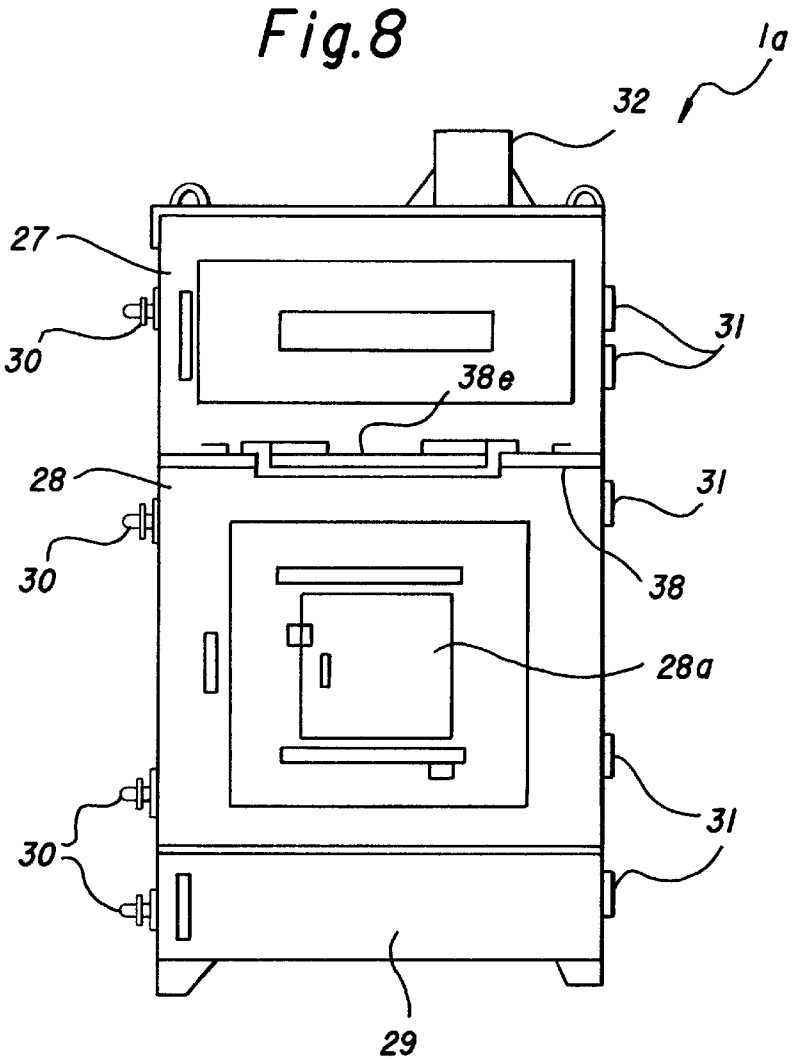
FIG. 8 is a front view of the incinerator including a drying chamber in accordance with the present invention.

FIG. 8 is a front view which shows a burning furnace including a drying chamber in accordance with the present invention, and FIG. 9 is a rear view thereof.

The burning furnace 1 including a drying chamber in accordance with the present invention is composed of burning chamber 28 for burning ordinary refuse, a drying chamber 27 for drying garbage containing moisture, an ash receiving chamber 29 including an ash receiving tray for receiving burned ordinary refuse and ash generated after completion of the burning of the garbage, a chimney chamber 42, a burner chamber 43 including a burner 45 and a blower chamber 44 including a blower 44*a*.

Opening/closing doors are openably fitted to the drying chamber 27, the burning chamber 28 and the ash receiving chamber 29 by hinges 31, and each door is attached to the drying chamber 27, the burning chamber 28 and the ash receiving chamber 28 by tightening members 30. Reference numeral 32 denotes a chimney through which smoke generated at the time of burning is discharged.

As shown in FIG. 9, opening/closing doors 33, 33*a* and 33*b* are attached to inspecting ports on the rear surface of the burning furnace, and an ash outlet door 33*b* is attached to an ash outlet.

The ash outlet door 33*b* is constructed so as to largely adjust an opening angle so that a quantity of suction air from the ash outlet port 33*c* can be adjusted by adjusting an opening angle of the ash outlet door 33*c*, as required.

Figure 10:
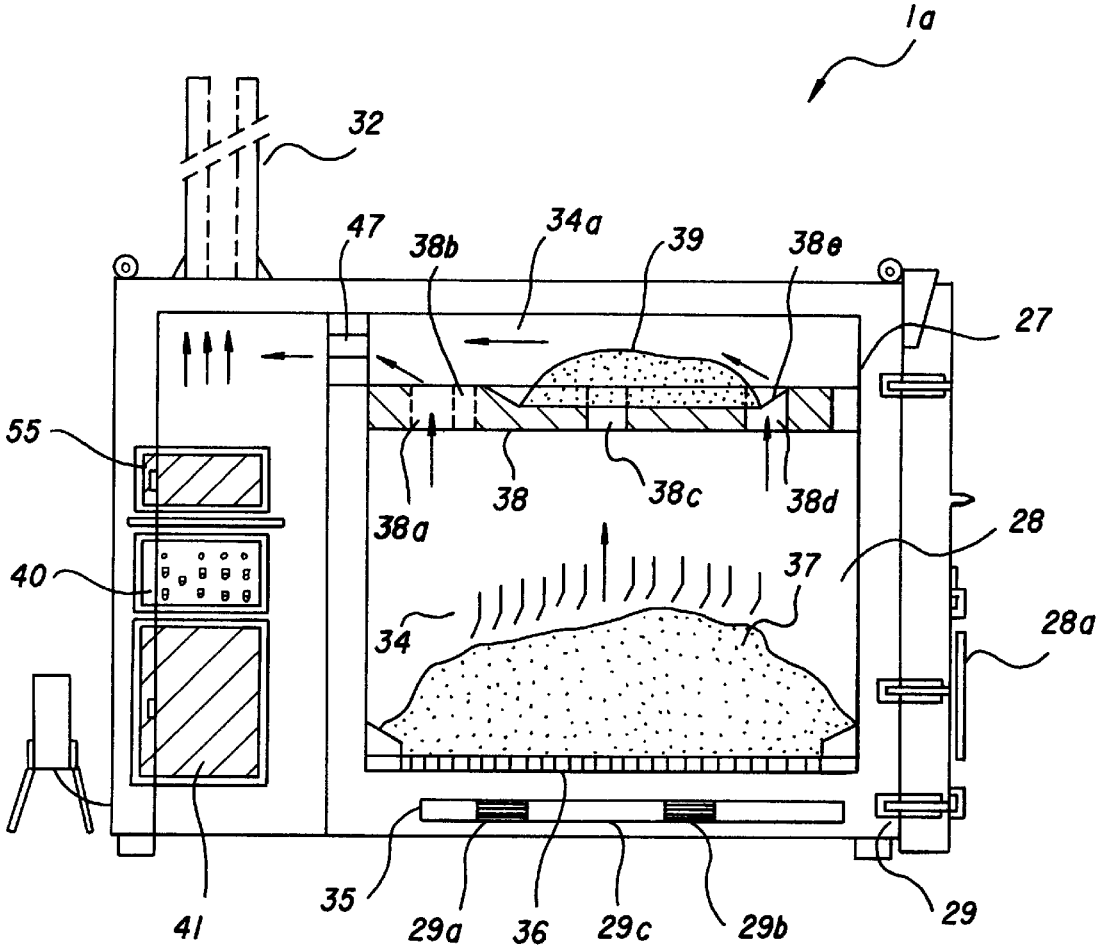
FIG. 10 is a vertical sectional view of an incinerator including a drying chamber in accordance with the present invention.

FIG. 10 is a vertical sectional view of the burning furnace including a drying chamber in accordance with the present invention. Ordinary refuse 37 containing little moisture is put in the burning chamber 34, and a vibrating plate 36 exhibiting a lattice-shaped contour is placed at the bottom of the burning chamber 34. The vibrating plate 36 is connected to a vibrator 46*a* so that it is vibrated at a predetermined time set by a timer so as to allow ash deposited on the vibrating plate 36 to drop in an ash receiving tray 35 in an ash receiving chamber 29. The ash receiving tray 35 is slidably received in the ash receiving chamber 20 and it can be drawn outside of the ash receiving chamber 29.

The inner wall of the burning chamber 34 is inclined at the lower part thereof so as to allow the material to be burned deposited on the inner wall to be smoothly displaced on the vibrating plate 36.

Reference numerals 29*a* and 29*b* denote air holes through which air is taken in the burning chamber 34. Reference numeral 29*c* denotes a bottom of the burning furnace 1*a* to which an air intake adjusting plate having a through-hole formed therein is attached. A quantity of intake air can be adjusted by actuating the air intake adjusting plate.

Figure 12:
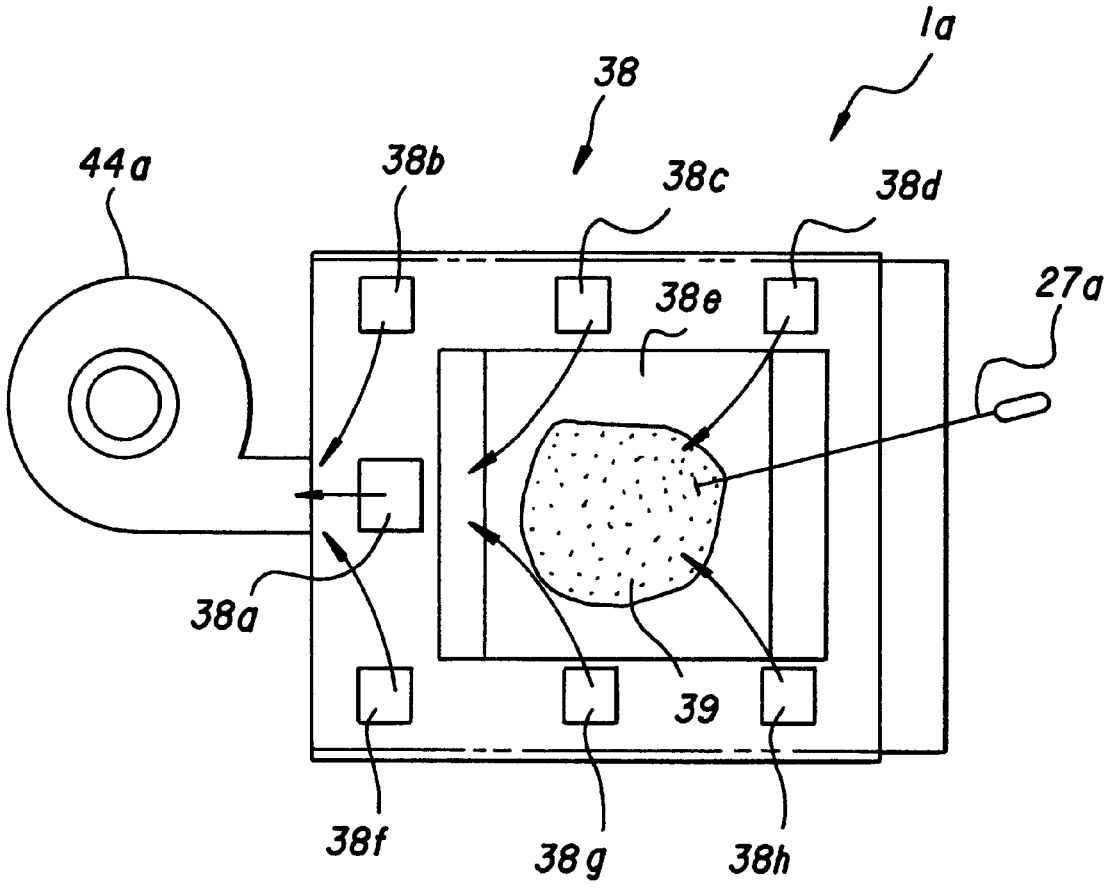
FIG. 12 is a plan view of a partition for the incinerator including a drying chamber in accordance with the present invention.

A partition 38 is disposed between the drying chamber 27 and the burning chamber 28, and a garbage receiving groove 38*e* is formed on the upper surface of the partition 38 to accumulatively receive garbage 39 therein. As shown in FIG. 12, a plurality of through-holes 38*a*, 38*b*, 38*c*, 38*d*, 38*f*, 38*g* and 38*h* are formed around the outer periphery of the garbage receiving groove 38*e* in such a manner as to surround the garbage receiving groove 38*e*.

Hot air generated by burning ordinary refuse 37 flow through the through-holes 38*a* to 38*h* to gradually dry garbage 39 including a large quantity of moisture received in the garbage receiving grooves 38*e* with the hot air.

The hot air generated by burning the ordinary refuse 37 flows through the through-holes 38*a*, 38*b*, 38*c*, 38*f*, 38*g* and 38*h* and then is forcibly discharged out of the chimney 32 by the blower 44*a* disposed in the blower chamber 44.

As the garbage 39 dried in the drying chamber 34*a* is raked out by actuating a raking rod 27*a*, the unburned garbage drops in the burning chamber 34 through the through-holes 38*a*, 38*b*, 38*c*, 38*d*, 38*f*, 38*g* and 38*h* so that it is burned in the burning chamber 28. With such construction, the garbage 39 which could hitherto not be treated by burning can be completely burned in the burning furnace 1*a*.

Figure 11:
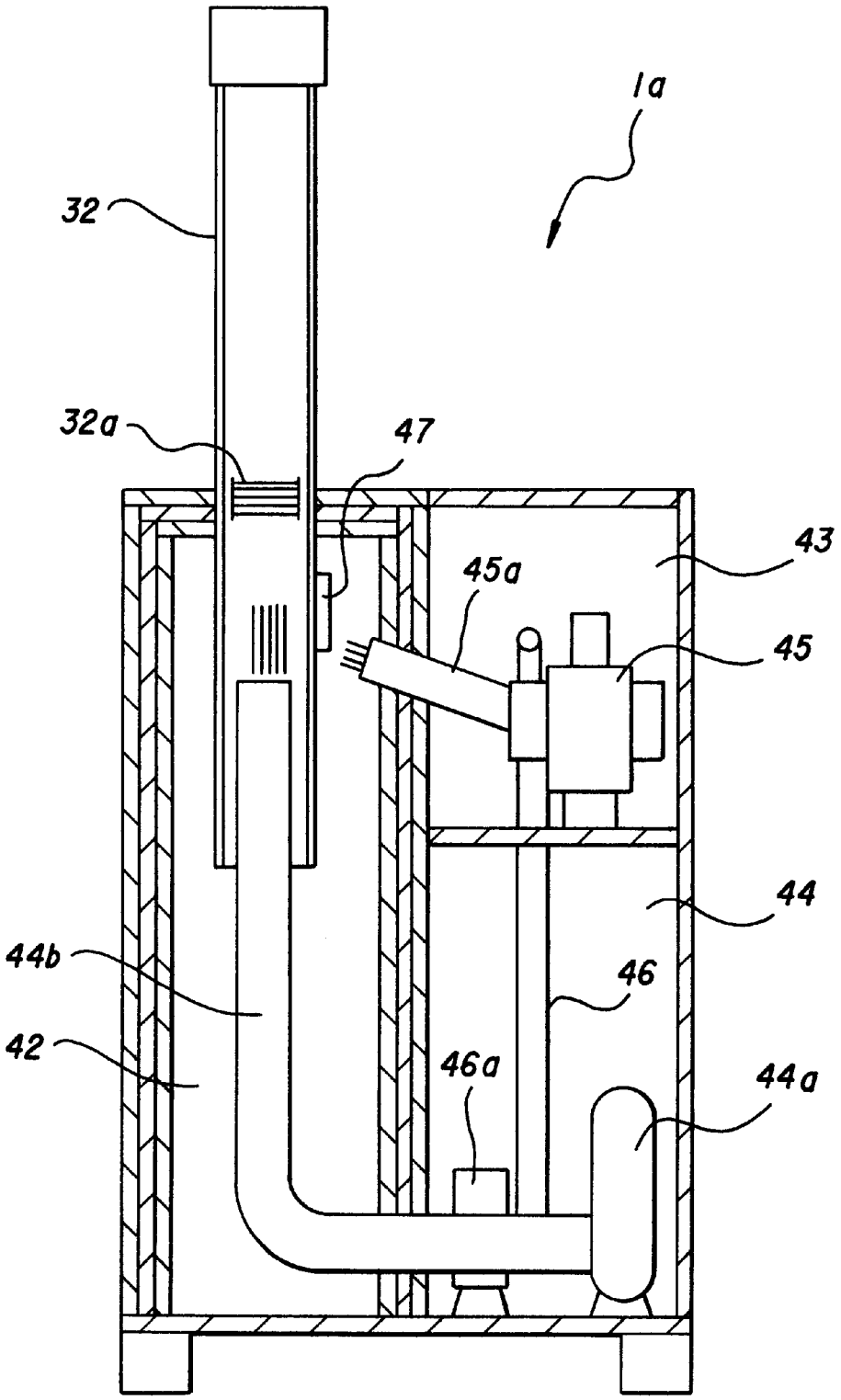
FIG. 11 is a vertical sectional view of the rear part of the incinerator including a drying chamber in accordance with the present invention.

FIG. 11 is a vertical sectional view which shows the rear part of the burning furnace including a drying chamber in accordance with the present invention. As shown in the drawing, a burner chamber 43 having an ignition burner 45 including an ignition sleeve 45*a* received therein, a blower chamber 44*a* in which a blower 44*a* including an air feeding pipe 44*b* having a branch pipe connected thereto and the blower 44*a* having a vibrator 46*a* disposed therein are arranged, and a chimney chamber 42 are arranged at the rear part of the burning furnace including a drying chamber in accordance with the present invention.

Reference numeral 32*a* denotes a heater. The heater 32*a* is intended to additionally burn the incompletely burned gas which enters from a discharge hole 47 into the chimney chamber 42 before it is discharged from the chimney 32. It, of course, is obvious that the heater 30*a* may not be required.

The ignition sleeve 45*a* is intended to completely burn the incompletely burned waste gas in the same manner as mentioned above. A branch pipe 46 is equipped with a change lever so that air is delivered to the burner 45 by actuating the change lever, as required to cool the ignition burner 45.

The air feeding pipe 44*b* fitted to the blower 44*a* is inserted into the lower part of the chimney 32, as mentioned above. The forward end part of the ignition sleeve 45*a* of the burner 45 is inserted into the chimney chamber 42, and as shown in FIG. 11, the ignition sleeve 45*a* is disposed to direct in a slight upward direction. Since the ignition sleeve 35*a* of the burner 45 is disposed in the upward direction in that way, an eddy current is generated at the upper part of the chimney chamber 42 to completely burn the incompletely burnt waste gas.

The chimney 42 is designed to have a hollow cylindrical contour in order to allow air to flow smoothly while forming an eddy current in the air. It, of course, is obvious that the ignition sleeve 42*a* may be disposed in a horizontal direction.

A fan of the blower 44*a* is normally driven so that the fan is normally rotated. This is because air flow in the chimney 42 is improved by normally rotating the fan of the blower 44*a*.

Specifically, since air in the burning chamber 28 and the drying chamber 27 is discharged from the discharge port 47 by normally driving the blower 44*a*, fresh air is sucked in the chimney chamber 42 from the drying chamber 27, and moreover, fresh air is sucked from the furnace floor 29*c* to the burning chamber 34, whereby the material to be burnt is completely burnt.

A shown in FIG. 11, when air is continuously fed from the air feeding pipe 44*b* to the chimney 32, the air pressure in the chimney chamber 42 is reduced, causing the hot air in the drying chamber 34*a* to be sucked from the discharge port 47 into the chimney chamber 42 formed at the rear wall of the drying chamber 34*a*. Then, since the sucked hot air is discharged from the chimney, fresh air flows in the drying chamber 34*a* so that the material 37 to be burned is burned and the garbage 39 is dried whereby the ordinary refuse 37 and the garbage 39 can simultaneously be burned at a high efficiency.

Figure 13:
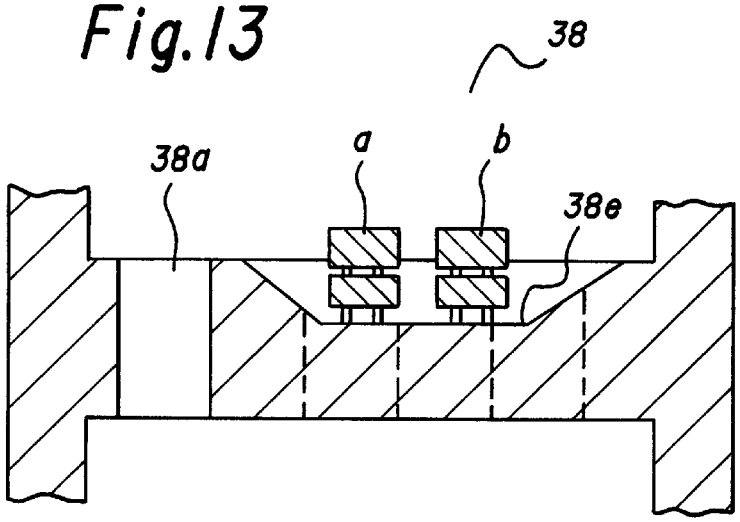
FIG. 13 is a vertical sectional view of a partition for the incinerator including a drying chamber in accordance with the present invention.

FIG. 13 is a vertical sectional view of a partition 38 which is disposed between the burning chamber and the drying chamber of the burning furnace including a drying chamber in accordance with the present invention.

A material of the partition 38 shown in FIG. 13 is made of a ceramic material, and the receiving groove 38*e* in which garbage, sludge, or the like, is recessed and has a mortar-lined sectional contour.

Reference characters a and b denote molded products each made by mixing the burnt ash generated from the refuse burned in the burning furnace 1 of the present invention and sludge or burnt ash and clay and then molding the mixture to a brick-like contour. The sludge-molded products a and b are placed on the receiving groove 38*e* and dried in the burning chamber 34*a* whereby quasi-bricks employable for building works can be produced.

Figure 14:
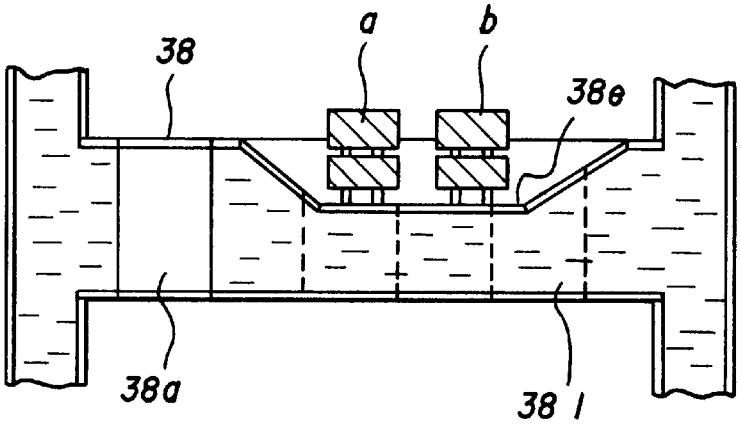
FIG. 14 is a vertical sectional view of another embodiment of the partition for an incinerator including a drying chamber in accordance with the present invention.

FIG. 14 is a vertical sectional view which shows another embodiment of a partition for the burning furnace including a drying chamber in accordance with the present invention. In this embodiment, cooling water 38*e* is recirculated in the partition 38 in order to prevent the partition 38 from being excessively heated by high temperature generated in the burning chamber.

Figure 15:
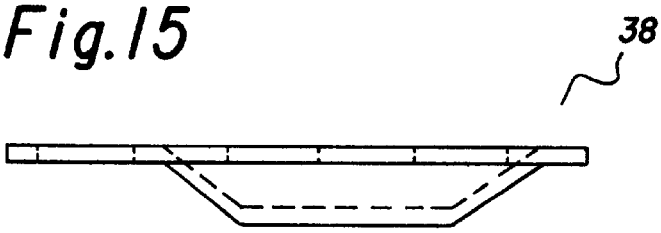
FIG. 15 is a vertical sectional view of yet another embodiment of the partition for the incinerator including a drying chamber in accordance with the present invention.

FIG. 15 is a vertical drawing which shows another embodiment of a partition disposed between the burning chamber and the drying chamber of the burning furnace including a drying chamber in accordance with the present invention.

In this embodiment, the partition 38 is made of a casting having a thin wall. By forming the partition with the casting in that way, the burning chamber and the drying chamber can be wider.

Figure 16:
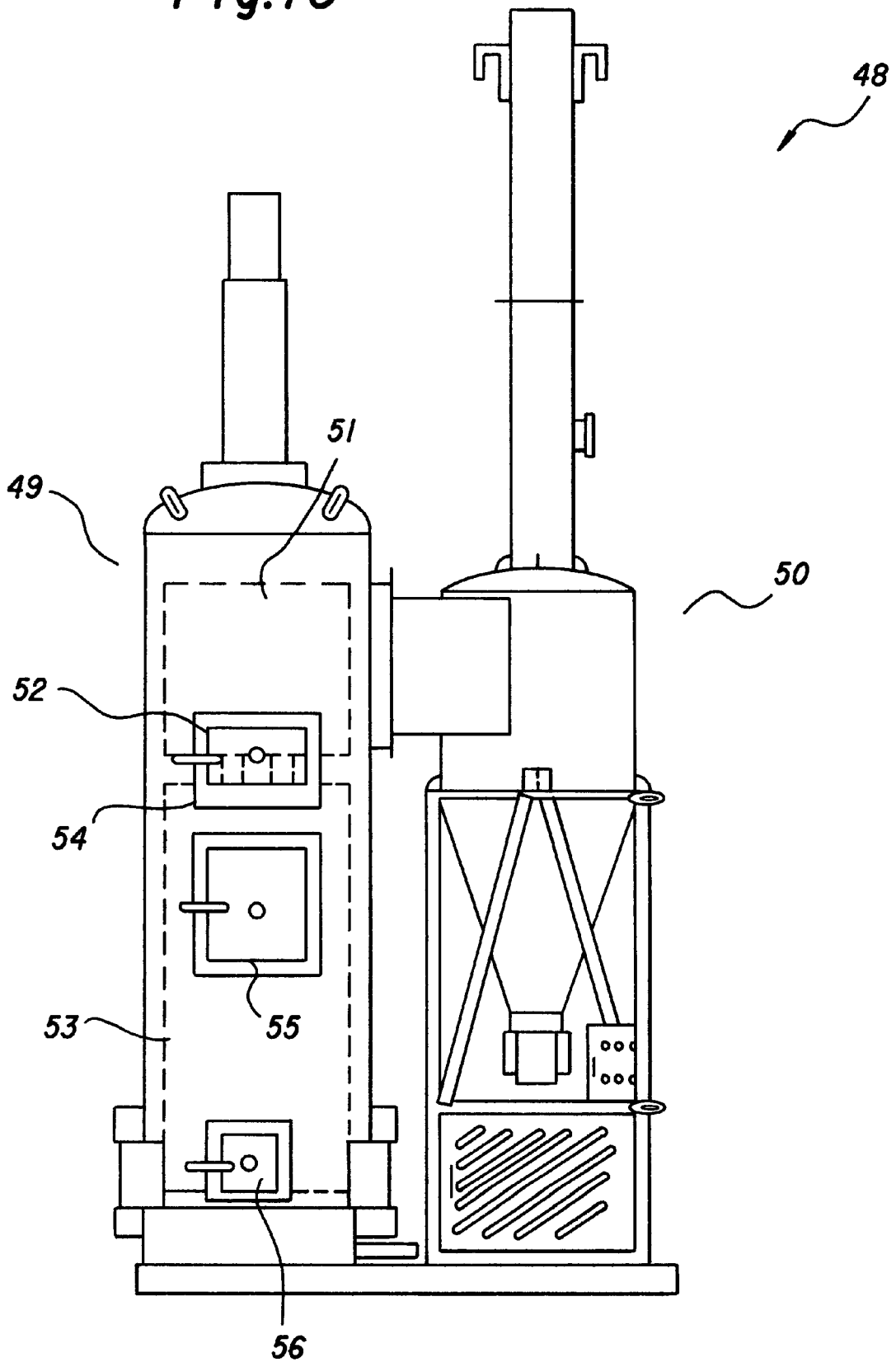
FIG. 16 is a front view of another embodiment of the incinerator including a drying chamber in accordance with the present invention.
Figure 18:
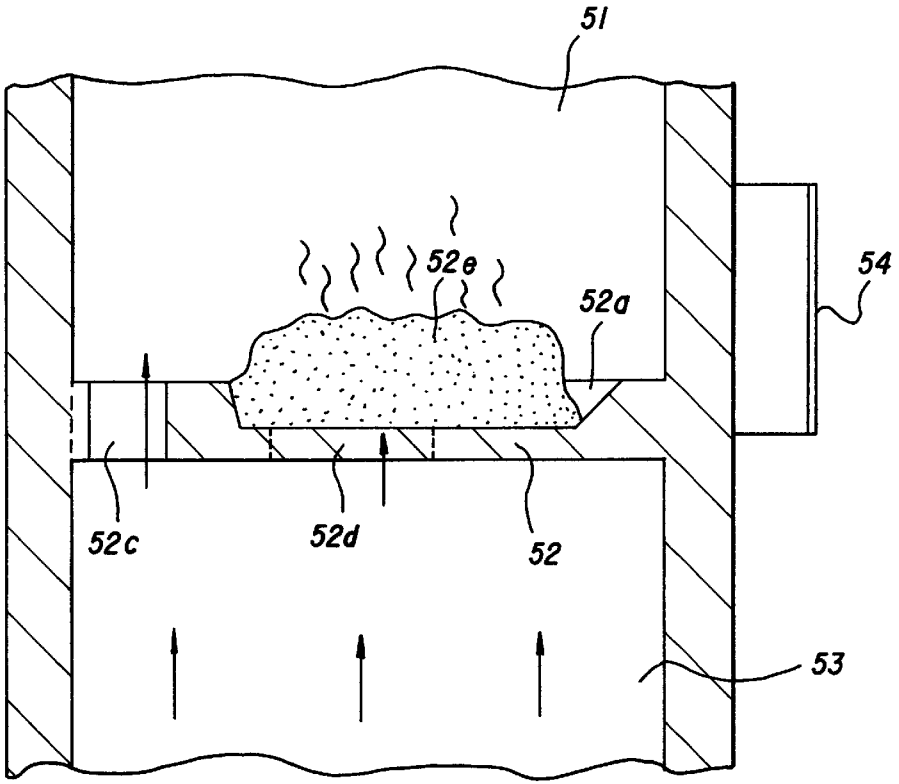
FIG. 18 is a vertical sectional view of the drying chamber of another embodiment of the incinerator including a drying chamber in accordance with the present invention.

FIG. 16 is a front view which shows another embodiment of the burning furnace including a drying chamber in accordance with the present invention. In this embodiment, the burning furnace 48 including a drying chamber is composed of a burning furnace 49 and a cyclone 50. A burning chamber 53 and a drying chamber 51 are arranged in the burning furnace 49, and a partition 52 is interposed between the burning chamber 51 and the drying chamber 51. As shown in FIG. 18, a receiving groove 52*a* for receiving garbage and sludge is formed in the partition 52.

Figure 17:
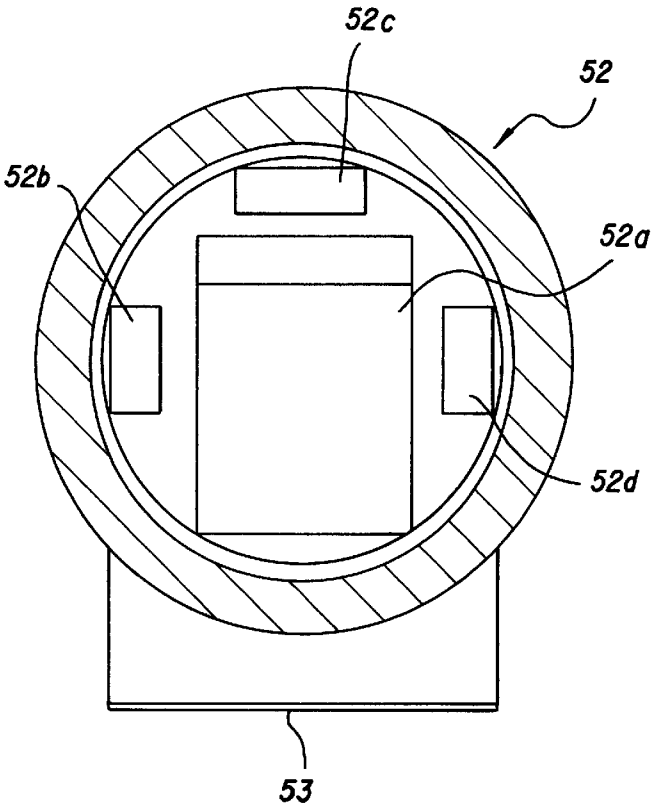
FIG. 17 is a plan view of another embodiment of a partition for the incinerator including a drying chamber in accordance with the present invention.

FIG. 17 is a plan view which shows the partition 52 for the burning furnace including a drying chamber shown in FIG. 16, and FIG. 18 is a vertical sectional view which shows the drying chamber of the burning furnace including the drying chamber shown in FIG. 16.

In this embodiment, the partition 52 is formed of a mortar-like material and includes a receiving groove 52*a* at the central part, and moreover, includes a plurality of through holes 52*b*, 52*c* and 52*d* at the positions located outside of the receiving groove 52*a*.

To assure that the burning furnace 48 including a drying chamber is centrally controlled at a single location, a switch board 40 is disposed between the burner chamber 43 and the blower chamber 44, and ON/OFF button and various buttons for driving a vibrator 46*a*, a blower 44*a*, a burner 45, or the like, and a timer for actuating a vibrator 46*a* for a predetermined time are arranged on the switch board 40.

Each of chambers 27, 28, 42, 43 and 44 for the burning furnace 48 including a drying chamber has a three layered structure. Specifically, each chamber is composed of an inner layer, an intermediate layer and an outer layer, and cast refractory is used for the inner later, ceramic wool or caster is used for the intermediate layer and glass wool or heat resistant board is used for the outer layer.

The burning furnace 1*a*, including a drying chamber in accordance with the present invention, is constructed to include a lattice-like plate but not include a vibrating plate 36 adapted to vibrate.

Industrial Applicability

As is apparent from the above description, the burning furnace including a vibrator, as well as the burning furnace including a drying chamber, in accordance with the present invention can completely burn any material to be burned without discharging non-inflammable gas, resulting in the burning furnace being satisfactorily acceptable from the viewpoint of the environment.

In addition, even through the burning furnace continues to burn a material to be burned, the burning section is not excessively heated, and the ash generated by burning the material to be burned automatically drops in the ash receiver without any obstacle of feeding oxygen due to the deposited ash. Consequently, any material to be burned can be efficiently burned.

Further, ordinary refuse containing little moisture, as well as garbage containing a large quantity of moisture, can easily be instantaneously burned.

I claim:

1. An incinerator, comprising:

a plurality of substantially rectangularly disposed, upstanding walls defining an enclosure containing a burning chamber, a blower chamber, a chimney chamber, and an ash-receiving chamber;

a holding plate disposed between said burning chamber and said ash-receiving chamber, said holding plate being operative to hold refuse to be burned and containing holes for the transfer of ash from said burning chamber to said ash-receiving chamber;

one of said walls containing a suction-discharge port establishing communication between said burning chamber and said chimney chamber;

a chimney extending from said chimney chamber and being operative to discharge gases from said chimney chamber to the atmosphere;

a burner disposed in said burning chamber and having an ignition sleeve communicating with said chimney chamber;

a blower disposed in said blower chamber and having an air feeding pipe extending into said chimney, and a branch pipe extending from said air feeding pipe into said burning chamber and having its discharge end disposed adjacent said burner.

2. An incinerator according to claim 1 including a vibrator connected to said holding plate for vibrating said holding plate to induce the passage of ash into said ash-receiving chamber.

3. An incinerator according to claim 1 including a heater disposed in said chimney and operative to burn consumable matter flowing through said chimney.

4. An incinerator according to claim 1 in which said ignition sleeve is disposed at an upwardly inclined attitude in said chimney chamber.

5. An incinerator according to claim 1 in which said branch pipe includes a change lever operative to regulate the flow of air through said branch pipe.

6. An incinerator according to claim 1 including upper and lower doors disposed in a wall defining said burning chamber, and wherein said walls defining said burning chamber and said doors are formed of a three-layered structure comprising an inner material, an intermediate material and an outer material.

7. An incinerator according to claim 1 including a switch board having a plurality of switches for operating said incinerator and being disposed centrally between said burning chamber and said blower chamber.

8. An incinerator according to claim 1 including a partition disposed in said burning chamber and defining a drying chamber above said burning chamber, said partition containing a receiving groove operative to hold garbage to be dried and a plurality of through-holes in said partition operative to establish communication between said burning chamber and said drying chamber.

9. The incinerator according to claim 8 including a cyclone communicating with said drying chamber.

* * * * *